US012643581B2

(12) United States Patent
Berg et al.

(10) Patent No.: US 12,643,581 B2
(45) Date of Patent: Jun. 2, 2026

(54) COUPLER KNUCKLE INTERNAL PIVOT PIN SUPPORT

(71) Applicant: NEW YORK AIR BRAKE, LLC, Watertown, NY (US)

(72) Inventors: Thomas Berg, Clever, MO (US); Jerome O'Rourke, Henderson, NY (US)

(73) Assignee: NEW YORK AIR BRAKE LLC, Watertown, NY (US)

( * ) Notice: Subject to any disclaimer, the term of this patent is extended or adjusted under 35 U.S.C. 154(b) by 686 days.

(21) Appl. No.: 18/015,187

(22) PCT Filed: Jul. 9, 2021

(86) PCT No.: PCT/US2021/041104
§ 371 (c)(1),
(2) Date: Jan. 9, 2023

(87) PCT Pub. No.: WO2022/011272
PCT Pub. Date: Jan. 13, 2022

(65) Prior Publication Data

US 2023/0249718 A1 Aug. 10, 2023

Related U.S. Application Data

(60) Provisional application No. 63/049,731, filed on Jul. 9, 2020.

(51) Int. Cl.
*B61G 3/04* (2006.01)

(52) U.S. Cl.
CPC ..... *B61G 3/04* (2013.01)

(58) Field of Classification Search
CPC ..... B61G 3/04
See application file for complete search history.

(56) References Cited

U.S. PATENT DOCUMENTS 2,088,135 A 7/1937 Johnson et al.
2,548,479 A 4/1951 Kayler
(Continued)

FOREIGN PATENT DOCUMENTS

CN 105083315 B 2/2018

OTHER PUBLICATIONS

International Search Report and Written Opinion PCT/US2021/041104, filed Jul. 9, 2021, pp. 1-9.

*Primary Examiner* — Robert J McCarry, Jr.
(74) *Attorney, Agent, or Firm* — David L. Nocilly; Bond, Schoeneck & King PLLC

(57) ABSTRACT

A knuckle for a rail car coupler that reduces bending of an intermediate portion of the pivot pin that coupled the knuckle to a rail car coupler. The knuckle has a body with a throughbore defining a first bearing surface at a first end of the throughbore and a second bearing surface and a second end of the throughbore. A support extends from the body into the throughbore and includes a third bearing surface positioned between the first bearing surface and the second bearing surface. When a pivot pin is positioned in the throughbore, it will contact the first bearing surface, the second bearing surface, and the third bearing surface, with the third bearing support protecting against bending of the pivot between the first and second bearing surfaces.

12 Claims, 8 Drawing Sheets

(56) References Cited

U.S. PATENT DOCUMENTS

| | | | | |
|---|---|---|---|---|
| 2,617,540 | A * | 11/1952 | Metzger | B61G 3/04<br>213/155 |
| 4,640,422 | A | 2/1987 | Elliott | |
| 10,399,580 | B2 | 9/2019 | Brook et al. | |

* cited by examiner

COUPLER KNUCKLE INTERNAL PIVOT PIN SUPPORT

BACKGROUND OF THE INVENTION

1. Field of the Invention

The present invention relates to rail car coupler knuckles and, more specifically, to an internal supporting structure for coupler knuckle pivot pins.

2. Description of the Related Art

Couplers are used to join rail cars and locomotives to each other so that they all securely linked together. The Association of American Railroads (AAR) standard coupler uses a knuckle that is pivotally mounted in the coupler by a pivot pin to engage and disengage from another coupler. Due to the forces involved in coupling and during transit, pivot pins experience significant loading and can bend and eventually break, thereby resulting in a failure of the pivot pin and coupler assembly. Depending on the geometry of the other parts of the coupler assembly, the load through the pivot pin may be increased and the bending more pronounced. As the load is increased, the fatigue life of the pivot pin can be dramatically reduced, thereby leading to premature failure of the pivot pin. Pin failure is evident when the knuckle is opened to uncouple a railcar, and the damaged pin allows the knuckle to fall out of the coupler body. Repairing this condition is particularly dangerous as repair personnel must work between the rail cars on an operating track, which presents a number of significant safety concerns. In some cases, pivot pin failure results in the pin becoming deformed along the portion that extends through the knuckle, which can result in the pivot pin being stuck inside the knuckle. In this situation, it may not even be possible to uncouple the railcar with the broken pin from another rail car, and to correct requires that repair personnel work between the cars of an operating track.

Conventional knuckle designs connect to the pin at two locations. The first location is approximately two and one quarter inches below the top of the head, which coincides with the top of the knuckle and coupler. The second location is approximately ten and one quarter inches below the top of the head, which coincides with the bottom of the knuckle and coupler after the pivot pin has passed through the knuckle. These connection points are not sufficient to prevent bending or failure of the portion of the pivot pin that extends within the knuckle itself. Some attempts to remedy this approach rely on a solid body knuckle with a throughbore that can accept the pivot pin. As a result, any bending of the pivot pin is restrained by the throughbore of the knuckle through which the pivot pin is passed. Solid body designs are significantly heavier than conventional designs, and can be more costly. In addition, the need for any pivot pin repairs necessarily delays operation of the train and can adversely impact other routes. As a result, there is a need in the art for an approach that can reduce the stress on the pin within the boundaries of the knuckle without having to employ a solid body structure.

BRIEF SUMMARY OF THE INVENTION

The present invention reduces the stress on the pivot pin of coupler by providing additional support for the pivot pin along the portion of the pivot pin that extends within the knuckle. More specifically, the knuckle of a coupler according to the present invention includes a support positioned along the portion of the pivot pin that extends through the knuckle between the upper and lower contact location. The support is positioned in a location that corresponds approximately to the mid-point of the pivot pin, at an orientation where maximum deflection of the pivot pin occurs during draft loading of the coupler, which is the loading condition that is most likely to result in failure of the pivot pin and knuckle. The present invention thus reduces stress at the most common failure location by limiting the physical amount the pin can bend with a structural feature that is internal of the knuckle and positioned in line with the draft loading direction so that pivot pin is supported against bending. The present invention thus provides a knuckle weight that is comparable to the weight of a standard knuckle and significantly less than a solid body knuckle.

In a first embodiment, the present invention is a knuckle for a rail car coupler having a body having a throughbore defining a first bearing surface at a first end of the throughbore and a second bearing surface and a second end of the throughbore and a support extending into the throughbore and including a third bearing surface that is positioned between the first bearing surface and the second bearing surface. The support may be a post extending from an interior surface of the knuckle into the throughbore. The body may include a series of hollow regions therein. The post may extend from the interior surface of the knuckle in one of the series of hollow regions. The post may be positioned so that the third bearing surface will abut a pivot pin that is inserted into and extends through the throughbore. The post may be positioned so that the third bearing surface will abut an intermediate portion of the pivot pin that extends between the first bearing surface and the third bearing surface. The post may be positioned so that the third bearing surface will abut a central point of pivot pin.

In a further embodiment, the support of the knuckle may be a bridge extending from a first interior surface of the knuckle across the throughbore to a second interior surface of the knuckle to form the third bearing surface between the first interior surface and the second interior surface. The support may be positioned so that the third bearing surface will abut a pivot pin that is inserted into and extends through the throughbore. The support may be positioned so that the third bearing surface will abut an intermediate portion of the pivot pin that extends between the first bearing surface and the third bearing surface. The support may be positioned so that the third bearing surface will abut a central point of pivot pin.

In an additional embodiment, the present invention may have a second support extending into the throughbore and including a fourth bearing surface positioned between the first bearing surface and the second bearing surface. The second support may be positioned so that the fourth bearing surface will abut a pivot pin that is inserted into and extends through the throughbore. The second support may be spaced apart from and extend in parallel to the first support. The first support and the second support may be positioned so that the third bearing surface and the fourth bearing surfaces are on opposing sides of a central point of the pivot pin.

BRIEF DESCRIPTION OF THE SEVERAL VIEWS OF THE DRAWING(S)

The present invention will be more fully understood and appreciated by reading the following Detailed Description in conjunction with the accompanying drawings, in which:

FIG. 1 is a railcar coupler according to the present invention;

FIG. 2 a perspective view of a knuckle for a railcar coupler according to the present invention;

DETAILED DESCRIPTION OF THE INVENTION

Figure 1:
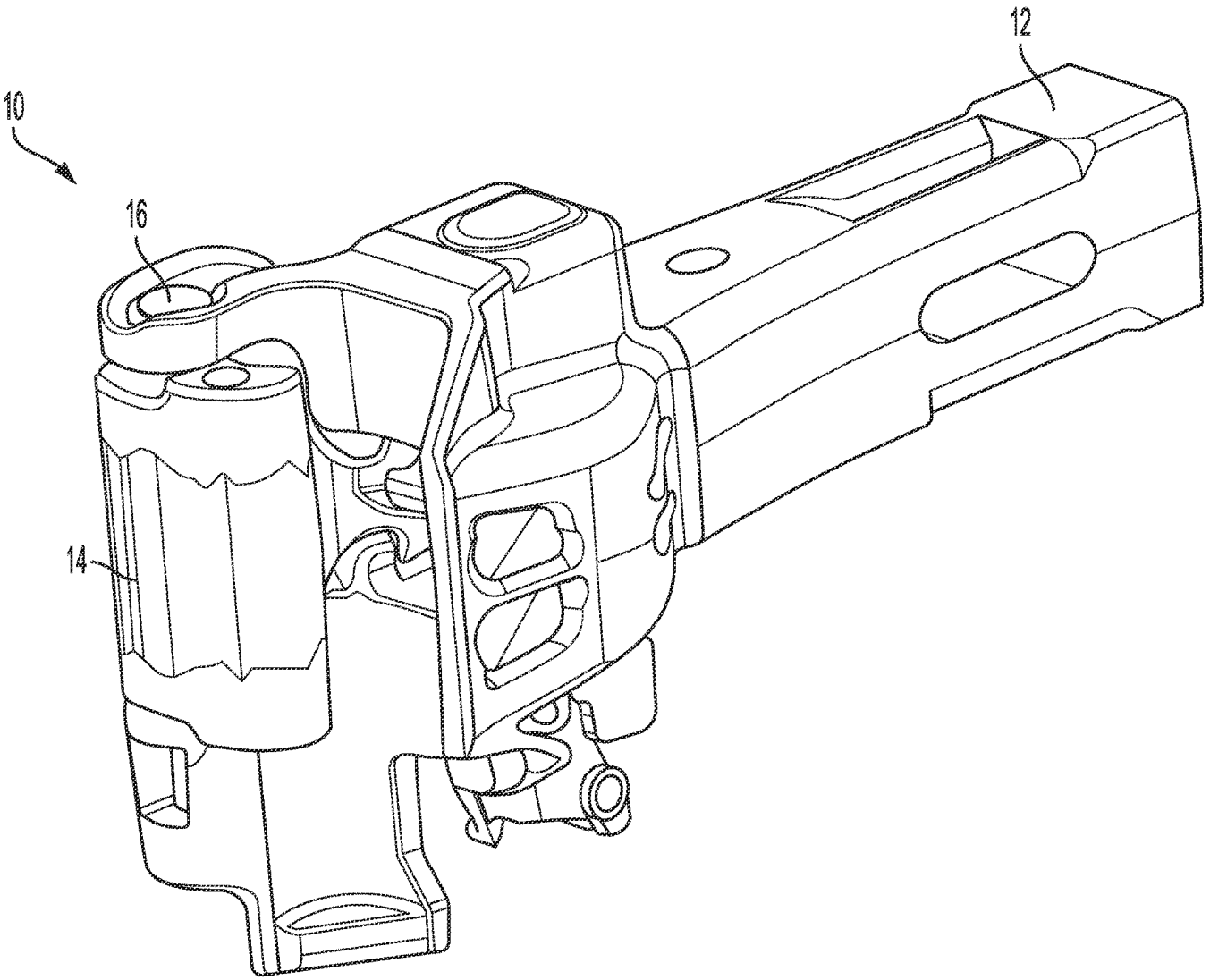
Figure 2:
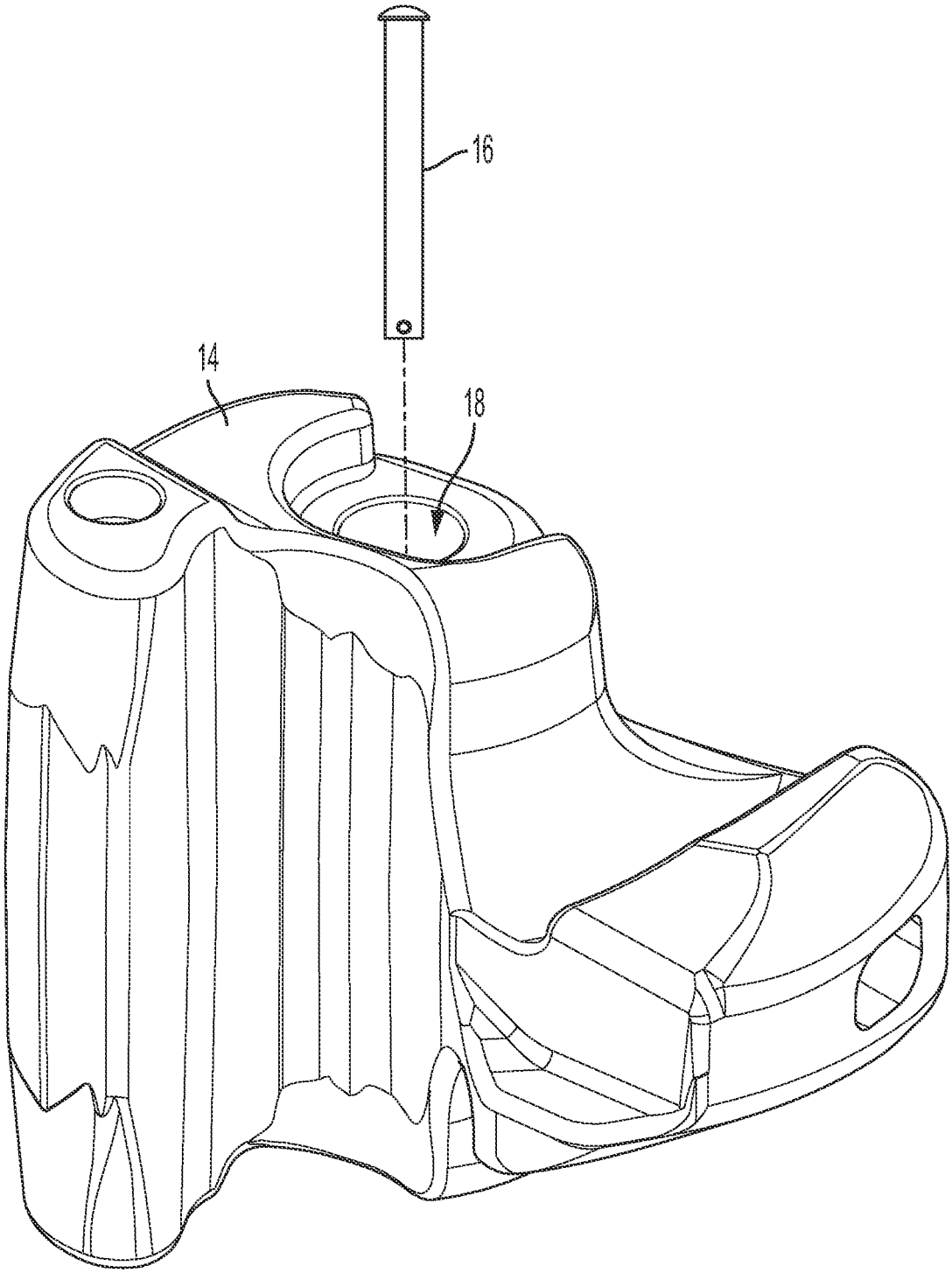

Referring to the figures, wherein like numerals refer to like parts throughout, there is seen in FIG. 1 a rail car coupler 10 having a main body 12 and a knuckle 14 pivotally mounted to main body 12 via a pivot pin 16. As seen in FIG. 2, knuckle 14 has a throughbore 18 dimensioned to accept pivot pin 16. Knuckle 14 is interconnected to main body 12 of coupler 10 via pivot pin 16 as it extends first through main body 12 and then bore 18 formed in knuckle 14 and then main body 12. It should be recognized that knuckle 14 includes conventional structures and surfaces for proper operation of knuckle 14 that is not pertinent to the present invention, including a heel, nose, front face, and the like.

Figure 3:
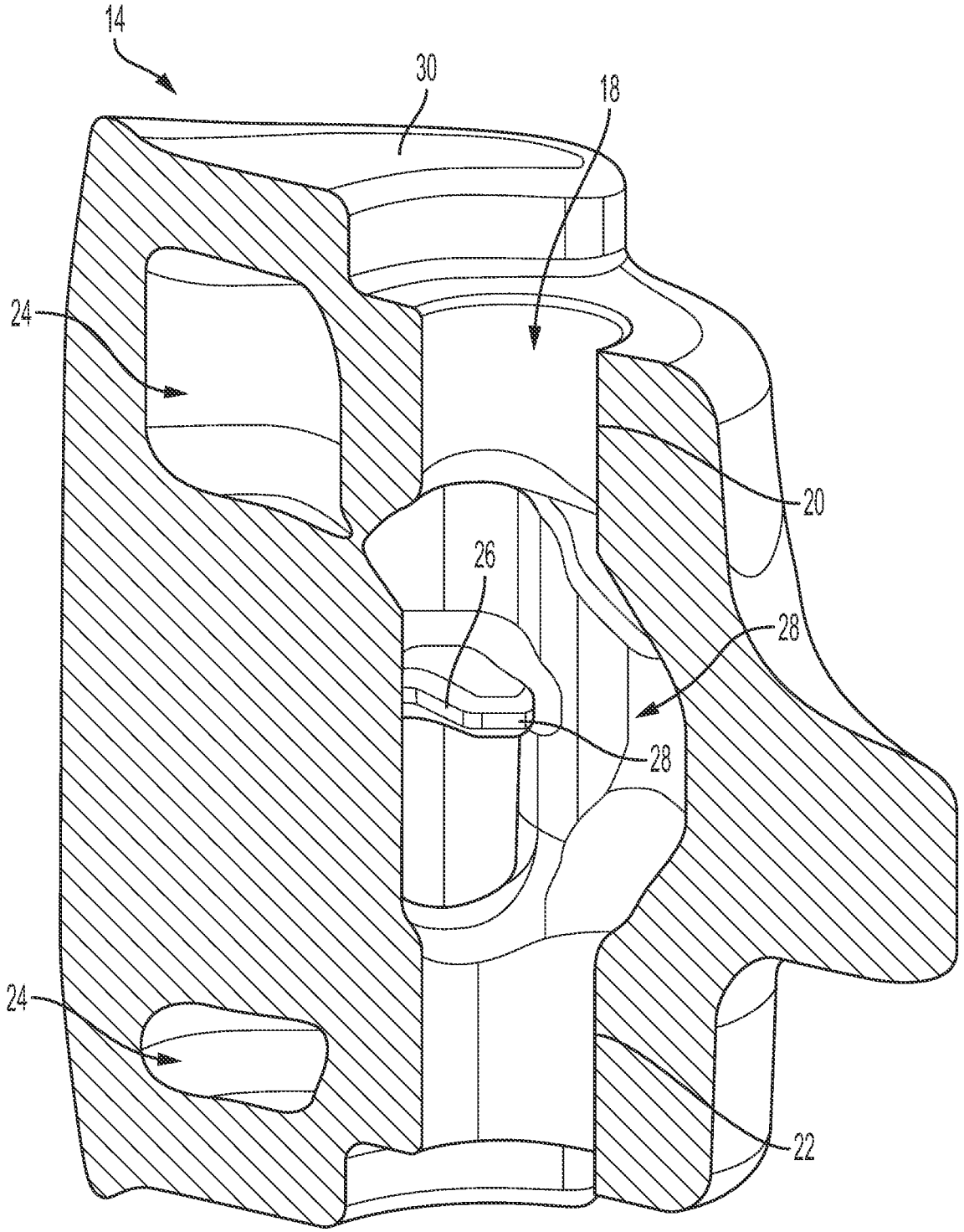
FIG. 3 is a cross-sectional view of a knuckle for a railcar coupler having an internal support according to the present invention.

Referring to FIG. 3, the main body 30 of knuckle 14 defines an upper bearing surface 20 and a lower bearing surface 22 extending around throughbore 18. Bearing surfaces 20 and 22 can be cylindrical or conical. To reduce the overall weight of knuckle 14 and coupler 10, knuckle 14 has hollow regions 24 positioned throughout knuckle 14 in locations that will not adversely impact the strength of knuckle 14, including along the portion of knuckle 14 that extends between bearing surface 20 and bearing surface 22. As further seen in FIG. 3, the interior of knuckle 14 includes a support 26 that integrally formed with knuckle 14 that extends into throughbore 18 to provide a third bearing surface 28 at the end of support 26 that is in close proximity to pin pivot 16. Support 26 is dimensioned and positioned to engage or closely abut pivot pin 16 when pivot pin 16 is positioned in throughbore 18 so that third bearing surface 28 rests on or is immediately adjacent pivot pin 16. To the extent that pivot pin 16 experience any forces tending to bend pivot pin 16, third bearing surface 28 will prevent or reduce bending of pivot pin 16 through direct contact with pivot pin 16. As seen in FIG. 3, support 26 may be formed as a post that extends from an interior surface of hollow region 24 of knuckle 14 and terminates to provide third bearing surface 28.

Figure 4:
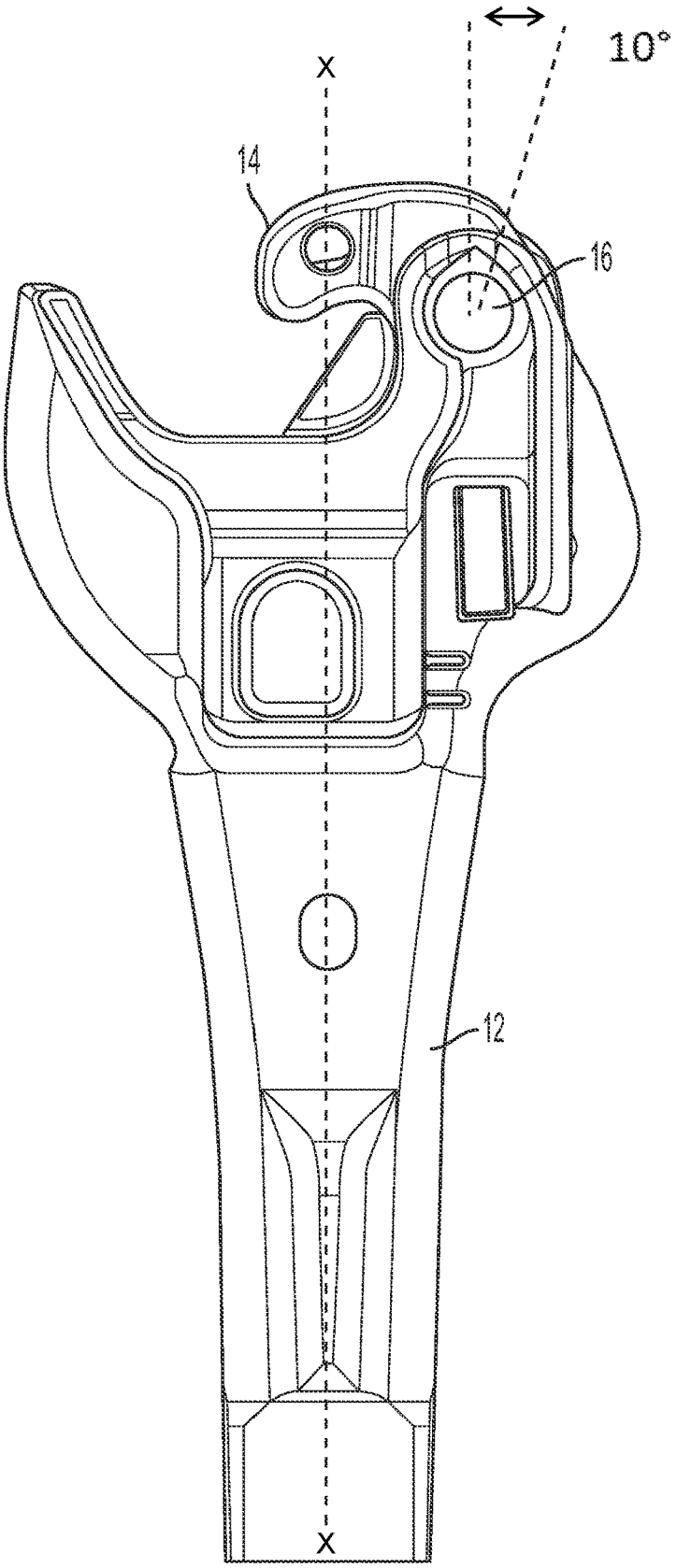
FIG. 4 is a railcar coupler according to the present invention showing the orientation of the present invention relative to the centerline of the coupler.

Preferably, support 26 is positioned in the interior of knuckle 14 so that it is located centrally along pivot pin 16 relative to bearing surface 20 and bearing surface 22 and so that it is in alignment with the direction of maximum pin deflection during draft loading of any rail car outfitted with coupler 10. Support 26 may be positioned anywhere along the length of pivot pin 16 that extends between bearing surface 20 and bearing surface 22, but is preferably located centrally within that length. The direction of maximum pin deflection during draft loading is shown in FIG. 4 as a slight offset (about 10 degrees) from the centerline A-A of coupler 12. As an option, more than one support 26 may be included in the interior of knuckle 14.

Knuckle 14 may be manufactured via casting or forging using conventional materials in the same fashion as conventional couplers, and may retrofit into legacy couplers 10 or included with new couplers 10. Knuckle 14 is depicted as an E-type, but it should be recognized by those of skill in the art than the present invention may be implemented in other designs, such as an F-type.

Figure 5:
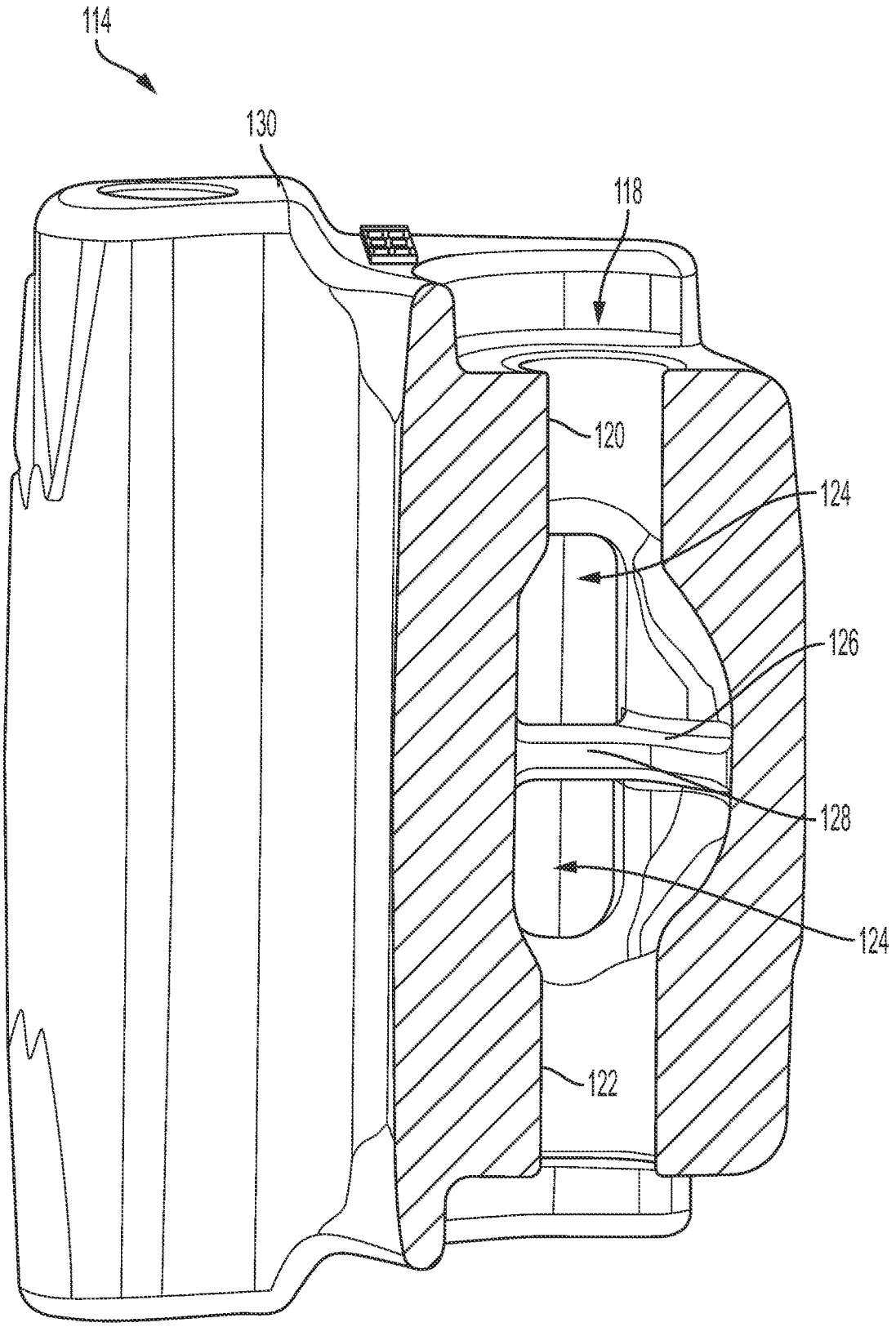
FIG. 5 is a first cross-sectional view of another embodiment of a knuckle for a railcar coupler having an internal support according to the present invention.
Figure 6:
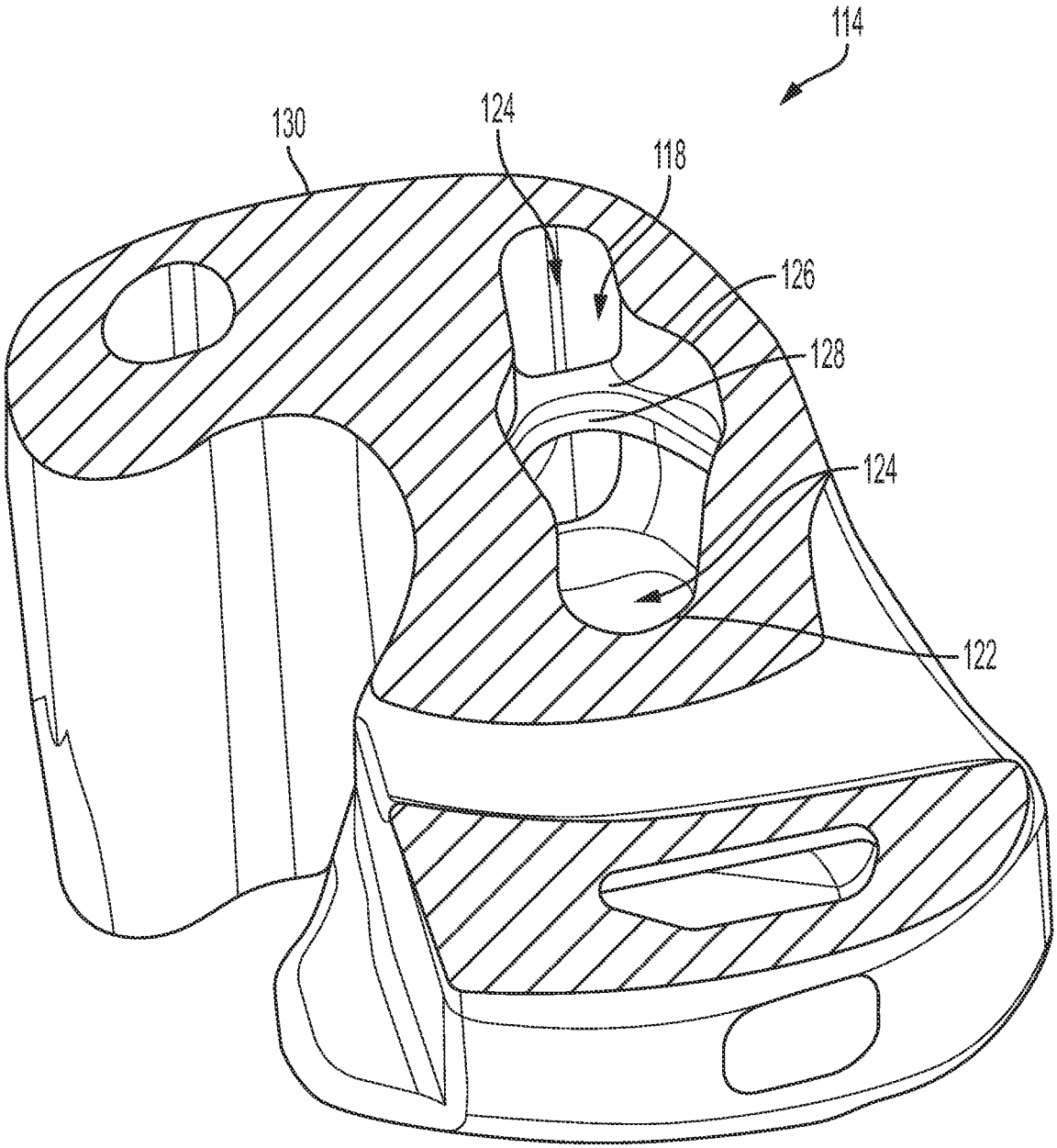
FIG. 6 is a second cross-sectional view of another embodiment of a knuckle for a railcar coupler having an internal support according to the present invention.
Figure 7:
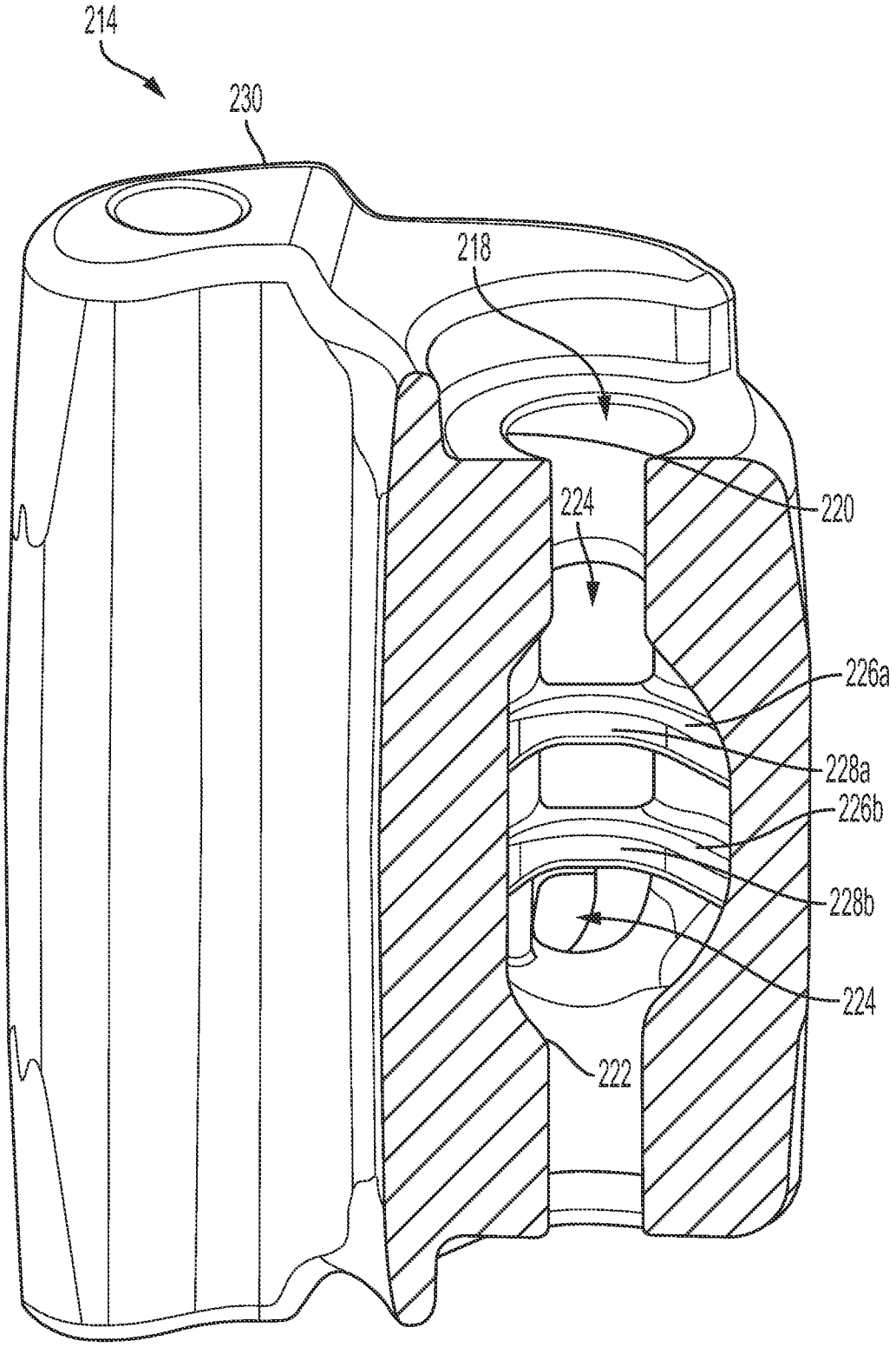
FIG. 7 is a first cross-sectional view of a further embodiment of a knuckle for a railcar coupler having an internal support according to the present invention.

Referring to FIGS. 6 and 7, in another embodiment of the present invention, knuckle 114 has a main body 130 defining an upper bearing surface 120 and a lower bearing surface 122 extending around a throughbore 118. Bearing surfaces 120 and 122 can be cylindrical or conical. To reduce the overall weight of knuckle 114 and coupler 10, knuckle 114 has hollow regions 124 positioned throughout knuckle 114 in locations that will not adversely impact the strength of knuckle 114, including along the portion of knuckle 114 that extends between bearing surface 120 and bearing surface 122. As further seen in FIGS. 5 and 6, the interior of knuckle 114 includes a support 126 that is integrally formed with knuckle 114 and extends across throughbore 118 to provide a third bearing surface 128 in throughbore 118 in close proximity to or in abutment with pivot pin 116. Support 126 is dimensioned so that third bearing surface will engage pivot pin 116 when pivot pin 116 is positioned in throughbore 118 so that bearing surface 128 rests on or is immediately adjacent pivot pin 16. To the extent that pivot pin 116 experience any forces tending to bend pivot pin 116, bearing surface 128 will reduce bending of pivot pin 116. As seen in FIGS. 6 and 7, support 126 may be formed as a bridge that extends from a first interior surface of knuckle 114 to a second interior surface of knuckle 114 positioned oppositely about throughbore 118 and across hollow region 124 from the first interior surface of knuckle 114.

Figure 8:
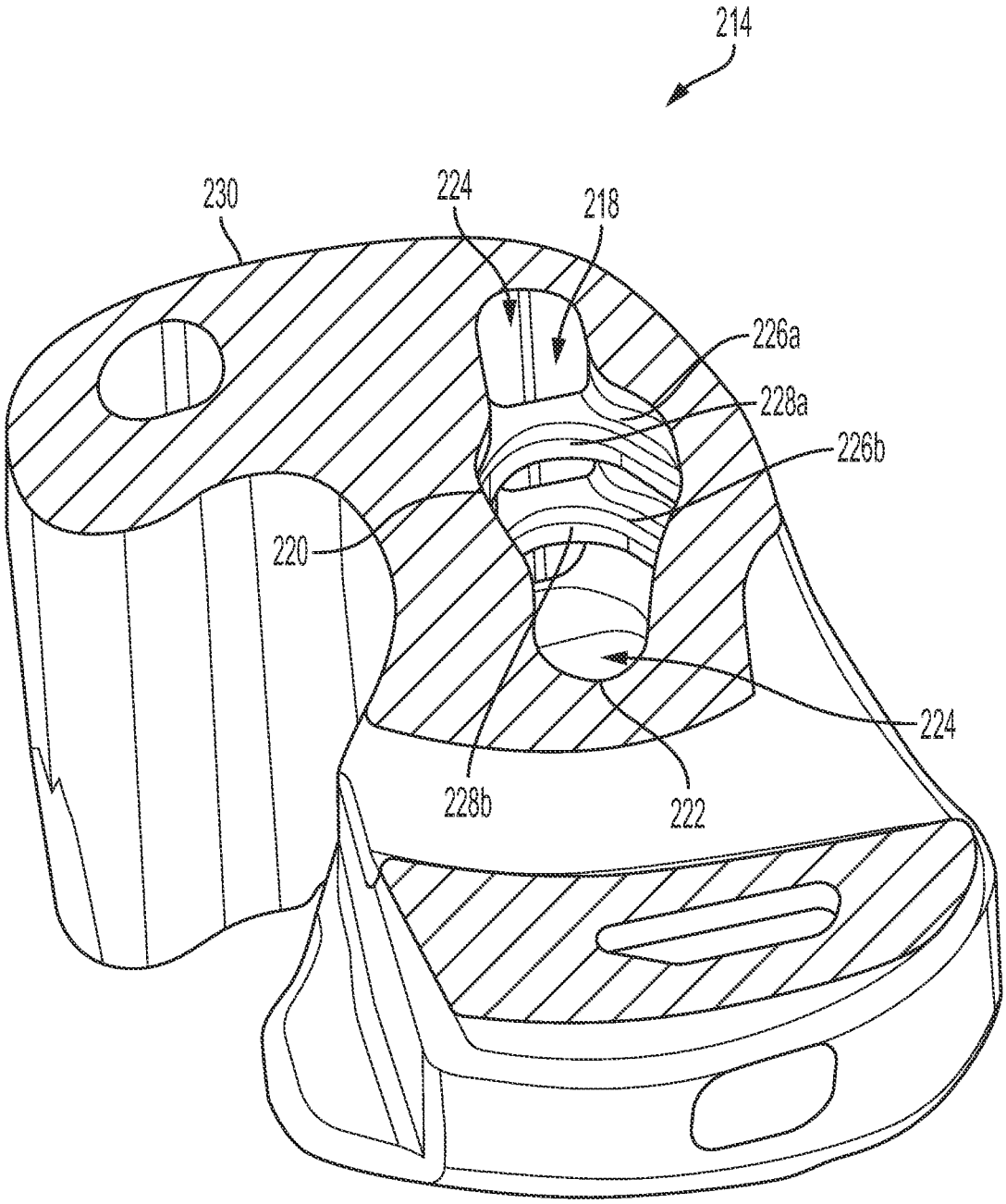
FIG. 8 is a second cross-sectional view of a further embodiment of a knuckle for a railcar coupler having an internal support according to the present invention.

Referring to FIGS. 7 and 8, in another embodiment of the present invention, knuckle 214 has a main body 230 defining an upper bearing surface 220 and a lower bearing surface 222 extending around a throughbore 218. Bearing surfaces 220 and 222 can be cylindrical or conical. To reduce the overall weight of knuckle 214 and coupler 10, knuckle 214 has hollow regions 224 positioned throughout knuckle 214 in locations that will not adversely impact the strength of knuckle 214, including along the portion of knuckle 214 that extends between bearing surface 220 and bearing surface 222. As seen in FIGS. 7 and 8, the interior of knuckle 214 includes a pair of supports **226*a* and 226*b* that are integrally formed with knuckle 214 and extend across throughbore 218 to provide a third bearing surface 228*a* and a fourth bearing surface 228*b* in close proximity to or in abutment with pivot pin 216. Supports 226*a* and 226*b* are dimensioned so that third bearing surface 228*a* and fourth bearing surface 228*b* will closely abut or directly engage pivot pin 216 when pivot pin 216 is positioned in throughbore 218 so that bearing surface 228 rests on or is immediately adjacent pivot pin 216. For example, supports 226*a* and 226*b* may be positioned about the central point of throughbore 218 so that they extend on either side of the central point of pivot pin 216 when pivot pin 216 extends within throughbore 218. As seen in FIGS. 7 and 8, supports 226*a* and 226*b* may be spaced apart from each other and extend in parallel across the interior of knuckle 214. To the extent that pivot pin 216 experience any forces tending to bend pivot pin 216, bearing surfaces 228***a* and 228*b* will reduce bending of pivot pin 216. As seen in FIGS. 8 and 9, supports 226*a* and 226*b* may be formed as a pair of bridges that extend from corresponding first interior surfaces of knuckle 214 to second interior surfaces of knuckle 214 positioned oppositely about throughbore 218 and across hollow region 224 from the first interior surfaces of knuckle 214.

What is claimed is:

1. A knuckle for a rail car coupler, comprising:

a body having a throughbore defining a first bearing surface at a first end of the throughbore and a second bearing surface and a second end of the throughbore; and a support extending into the throughbore and including a third bearing surface that is positioned between the first bearing surface and the second bearing surface, wherein the support is a post extending from an interior surface of the knuckle rearwardly relative to a centerline of the rail car coupler toward the throughbore, and wherein the interior surface of the knuckle does not include an additional bearing surface positioned oppositely about the throughbore from the third bearing surface.

2. The knuckle of claim 1, wherein the body includes a series of hollow regions therein.

3. The knuckle of claim 2, wherein the post extends from the interior surface of the knuckle in one of the series of hollow regions.

4. The knuckle of claim 3, wherein the post is positioned so that the third bearing surface will abut a pivot pin that is inserted into and extends through the throughbore.

5. The knuckle of claim 4, wherein the post is positioned so that the third bearing surface will abut an intermediate portion of the pivot pin that extends between the first bearing surface and the third bearing surface.

6. The knuckle of claim 4, wherein the post is positioned so that the third bearing surface will abut a central point of pivot pin.

7. The knuckle of claim 1, further comprising a second support extending into the throughbore and including a fourth bearing surface positioned between the first bearing surface and the second bearing surface.

8. The knuckle of claim 7, wherein the second support is positioned so that the fourth bearing surface will abut a pivot pin that is inserted into and extends through the throughbore.

9. The knuckle of claim 8, wherein the second support is spaced apart from and extends in parallel to the support.

10. The knuckle of claim 9, wherein the support and the second support are positioned so that the third bearing surface and the fourth bearing surfaces are on opposing sides of a central point of the pivot pin.

11. The knuckle of claim 1, wherein the post is aligned with a direction of maximum pin deflection.

12. The knuckle of claim 1, wherein the direction of maximum pin deflection is an angle of ten degrees relative to the centerline of the rail car coupler.

* * * * *